US010597969B2

(12) United States Patent
Minhas et al.

(10) Patent No.: US 10,597,969 B2
(45) Date of Patent: Mar. 24, 2020

(54) SEAL FOR A BOREHOLE

(71) Applicants: Naeem-Ur-Rehman Minhas, Al-Kohobar (SA); Gaurav Agrawal, Al-Khobar (SA); Asok Janardhanan Nair, Kerala (IN)

(72) Inventors: Naeem-Ur-Rehman Minhas, Al-Kohobar (SA); Gaurav Agrawal, Al-Khobar (SA); Asok Janardhanan Nair, Kerala (IN)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 273 days.

(21) Appl. No.: 15/606,205

(22) Filed: May 26, 2017

(65) Prior Publication Data

US 2018/0340393 A1 Nov. 29, 2018

(51) Int. Cl.
*E21B 33/127* (2006.01)
*E21B 33/12* (2006.01)

(52) U.S. Cl.
CPC ..... *E21B 33/1208* (2013.01); *E21B 33/127* (2013.01); *E21B 33/1277* (2013.01)

(58) Field of Classification Search
CPC . E21B 33/127; E21B 33/1277; E21B 33/1208
See application file for complete search history.

(56) References Cited

U.S. PATENT DOCUMENTS

2002/0189696 A1* 12/2002 Simpson ..... E21B 41/0042 138/89
2007/0068671 A1 3/2007 Lohbeck
2011/0048743 A1* 3/2011 Stafford ..... E21B 33/134 166/386
2011/0303421 A1 12/2011 Clint
2013/0220641 A1* 8/2013 Fripp ..... E21B 33/1208 166/386
2013/0220644 A1 8/2013 Fripp et al.

FOREIGN PATENT DOCUMENTS

WO 2016076853 A1 5/2016

OTHER PUBLICATIONS

Simonds, et al.; "Cup-seal packer enhan ces sand contorl in open-hole wells"; OffShore Magazine, vol. 75, Issue 1, Jan. 14, 2015; 6 pages. http://www.offshore-mag.com/1/volume-75/issue-1/prod/cup-seal/cup-seal-packer-enhanc.html.
Weatherford; "C-Range Packer Overview"; 2007; 16 pages.
Notification of Transmittal of the International Search Report and the Written Opinion of the International Searching Authority, or the Declaration; PCT/US2018/029535; dated Aug. 8, 2018; 9 pages.

* cited by examiner

*Primary Examiner* — Giovanna C Wright
(74) *Attorney, Agent, or Firm* — Cantor Colburn LLP

(57) ABSTRACT

A seal including a fluid resistive cover, a structured element disposed at an inside surface of the cover and drawable with the cover between a first position and a second position.

20 Claims, 6 Drawing Sheets

SEAL FOR A BOREHOLE

BACKGROUND

In the resource recovery industry boreholes are populated with strings of equipment. Oftentimes seals are needed between the equipment and the borehole wall or between radially spaced portions of strings. The seals, for example packers, come in many forms including compression set packers, inflatable packers, swellable packers, shape memory material packers, etc. These all work well for their intended purposes but as those of skill in the art will immediately recognize, even a full toolbox of solutions will leave an operator wanting for an alternative for a particular situation. Accordingly the art is always in need of new types of seals.

In more recent developments in the industry, higher expansion seals have become more desirable. There are of course limits to the radial displacement of for example a compression set packer. And while radial expansion limits of for example an inflatable packer are greater, the pressure requirements to generate sufficient radial contact force may be difficult. Accordingly, the art is also desirous of alternative high expansion packers.

SUMMARY

A seal including a fluid resistive cover, a structured element disposed at an inside surface of the cover and drawable with the cover between a first position and a second position.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
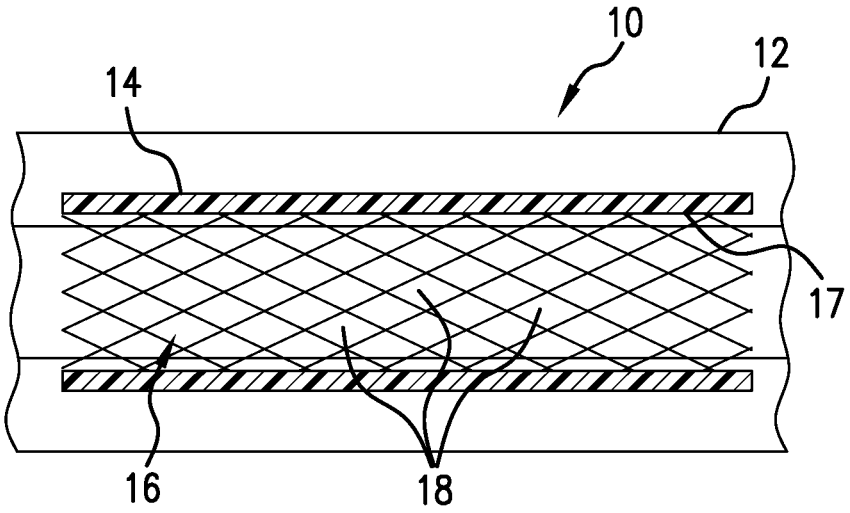
FIG. 1 is a schematic representation of a seal in a run in position.
Figure 2:
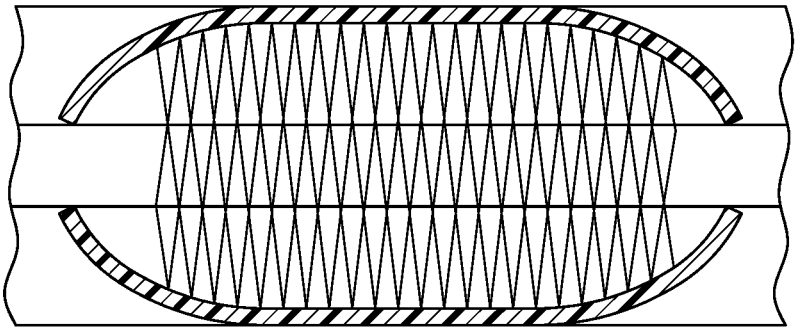
FIG. 2 is a schematic representation of the seal of FIG. 1 in a set position.

Referring to FIG. 1, a seal 10 is illustrated in a tubular 12 (part of a string, casing, open borehole, etc.) in which the seal 10 will be set. The set condition is shown in FIG. 2. The seal 10 is an inflatable type seal having a fluid impermeable or at least fluid restrictive cover 14 capable of containing fluid pressure to set the seal 10 and thereafter, restrict or prevent the migration of fluids past the seal 10 in the tubular 12. Materials for the cover include rubber, plastic, and other materials that will be recognized by those of skill in the art as inflatable type packer materials. The cover also may comprise composite materials such as Aramid fiber reinforced material. The seal further comprises a structured element or elements 16 that are disposed at an inside surface 17 of the cover 14 and configured to move (be drawn) with the cover 14 and support the same in a set position (FIG. 2). More specifically, the structured element(s) 16 follow the cover, meaning that when an inflation fluid is introduced to the seal 10, the application of differential pressure across the fluid resistive cover material will cause the cover to expand radially outwardly and that movement will move the structured element(s) 16 radially outwardly with the cover since they are bonded or otherwise connected thereto.

In the illustrations of FIGS. 1 and 2 it will be appreciated that the structured element 16 is in the form of a mesh having a plurality of diamond shapes 18. In FIG. 1 it can be seen that the diamond shapes 18 are elongated in a longitudinal direction of the seal 10 whereas in FIG. 2, it will be noted that the diamond shapes 18 are elongated in a circumferential direction of the seal 10. During setting of the seal 10 from the FIG. 1 position to the FIG. 2 position, the seal 10 is inflated resulting in the shortening of the structured element 16 in the longitudinal direction and the expanding of the structured element 16 in the radial direction. Once in the fully radially expanded direction, the structured element 16 helps to support the set position for the seal 10.

The support garnered comes from the specific structural geometry of the structured element(s). The structured element comprises components 20 that are translatable during setting from a first position (e.g. FIG. 1 position) where the cover 14 is allowed to have a smaller radial dimension and a second position (e.g. FIG. 2 position) that supports the cover 14 in a greater radial dimension. As such, the structured element 16 along with the rest of seal 10 can be run into a tubular system, of which tubular 12 is a part, and then set in the tubular 12 to produce a pressure tight seal therein. In the embodiment illustrated in FIG. 1A, the rigid or semi rigid components of a single diamond shape 18 are in four portions, and are numbered as portions 22, 24, 26 and 28. Each of the diamond shapes, in one embodiment are of the same dimensions and hence have the same numbered rigid or semi rigid components for each adjacent shape (see FIG. 1A), although it is to be understood that other specific geometries are contemplated for the one or more structured elements 16 in an embodiment of seal 10. This is the case for different geometric shapes that repeat as do the diamond shapes in FIG. 1, or for structured elements that include within them more than one geometric shape or more than one size of a repeating geometric shape.

Figure 1A:
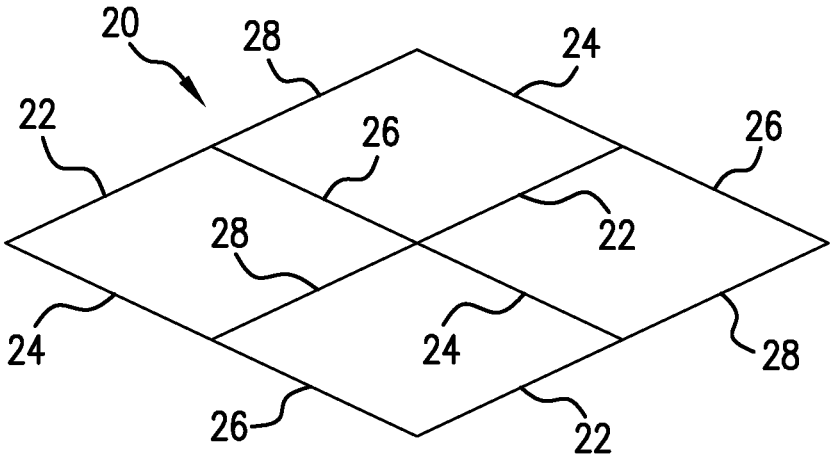
FIG. 1A is an enlarged view of a part of the structured element of FIG. 1 in an enlarged view in a run in position.
Figure 2A:
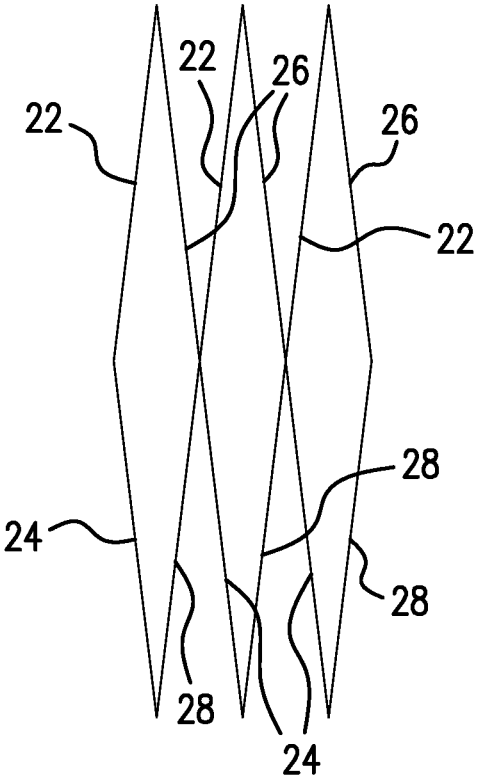
FIG. 2A is an enlarged view of a part of the structured element as illustrated in FIG. 2 in an enlarged view in a set in position.

Referring to FIGS. 1A and 2A, it can be seen that the positional difference brings portions 22 and 24 into a more linear alignment with each other and portions 26 and 28 into a more linear alignment with each other. It is the alignment that provides the support for the cover 14 as the hoop strength of the structured element 16 grows as the linear alignment of portions 22 and 24 and portions 26 and 28 increases.

Considerations related to effective construction of the seal 10 include the overall perimetric dimensions anticipated to be encountered in the target setting area. This will dictate the desired length of each of portions 22, 24, 26 and 28. It is to be understood that the perimeter may be a circle and hence have a circumferential measurement or may be any other tubular geometric shape and hence have a measurement that is not circumferential but is still a measurement along the perimeter of the particular shape. The measurement is accordingly herein termed a perimetric measurement or other formative term that properly fits the sentence in which the measurement is addressed. The lengths of 22/24 and 26/28 when combined should be about the same as the measured perimeter of the tubular in which the seal 10 is to be set. This of course means that when the portions are aligned, they represent a length of material that is about the same as the perimetric dimension where the seal 10 is set so that the cover 14 will necessarily be forcefully pressed into contact with the tubular 12.

A feature of the seal 10 is that the structured element(s) 16 facilitate the ordered packaging of material of cover 14. Specifically, with the structured elements 16 bonded to the cover 14 (by bonding or as a byproduct of the entire cover and structured element being additively manufactured together) the cover 14 will have a certain amount of material in the diamonds of the structured elements. That material will gather upon collapsing of the seal 10. Since the gathering will happen in the same way in each of the diamonds, the distribution of gathered material will be consistent and hence will pack in a more orderly and compact way. This is significant in that more material is packable into a smaller package for run in than was possible in the prior art. More material packed for run in translates to greater expansion ratios during deployment. Seals 10 as disclosed herein are capable of expansion ratios five times that of traditional inflatable packers.

In one embodiment, the structured elements 16 comprise a dissolvable or degradable material such as INtallic™ controlled electrolytic metallic material available from Baker Hughes Incorporated Houston Tex. In such an embodiment, the structured element will function to support the cover 14 for a period of time and then degrade, removing the additional support for the cover 14.

Figure 3:
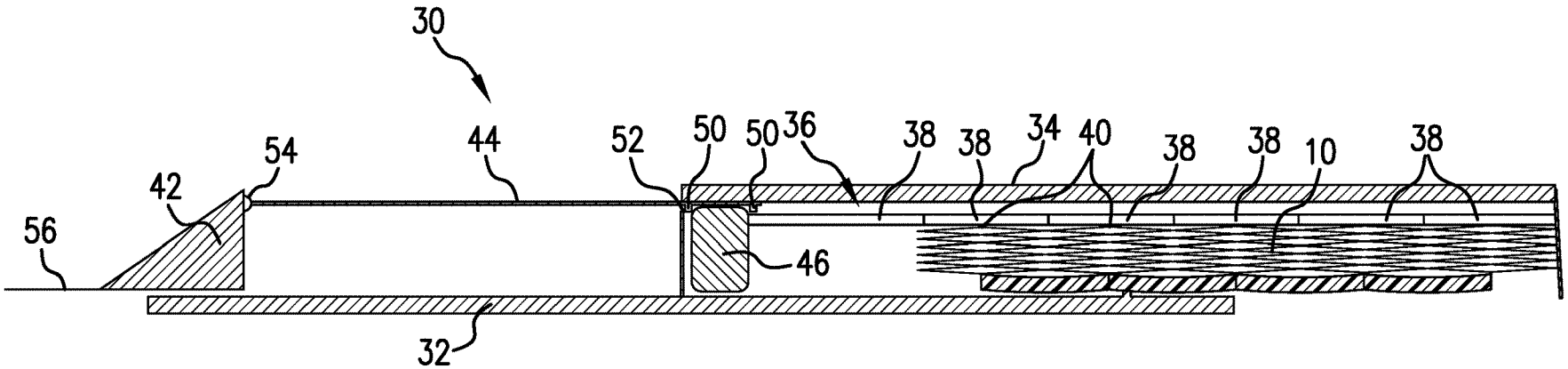
FIG. 3 is a schematic sectional view of an actuator arrangement for the seal disclosed herein.

Referring to FIG. 3-6, embodiments of actuation arrangements are illustrated. FIG. 3 illustrates an embodiment where the seal 10 is disposed in an actuation arrangement 30. The arrangement 30 includes an outer tubular 32 and an inner tubular 34, the seal 10 being disposed between the two for run in. Attached to the structured elements 16 is a telescoping member 36. It should be appreciated that each section 38 is nestable into the next adjacent section 38 and as such means that attachment points 40 of the structured elements 16 with the sections 38 may be manipulated with respect to distance between those attachment points. It will be appreciated that if the distance between adjacent points 40 is reduced, the diamond shape will change as was described hereinabove. Hence it will be understood that if the telescopic member is shortened in the embodiment of FIG. 3, will cause the structured elements 16 and hence the seal 10 to expand radially. Shortening of the telescopic member in this embodiment is accomplished by shifting the gate 42 toward the seal 10 usually by set down weight. It will be seen that the gate 42 is attached to an actuator sleeve 44. The sleeve 44 is operatively interconnected with a driver 46 through interconnections 50. The driver 46 is connected to the telescopic member 36 for compressional and tensile loads. It is also to be recognized that there is a fluid inlet port 52 placed to allow fluid access to the seal 10. Pressurized fluid may thus be applied through this port to inflate the seal 10. Once inflation is complete, it is desirable to prevent fluid escape so a seal 54 is provided on the gate 42 so that will full translation of the gate to the right in the figure, the seal 54 will mate with the port 52 and prevent fluid movement therethrough. It should at this point be understood that upon set down weight applied to the gate 42, and fluid pressure in the system, the seal 10 is inflated and mechanically urged radially outwardly to a set position. Upon reaching the fully set position, the seal 54 prevents fluid loss and will maintain the seal 10 in the set position. The structured elements having been radially expanded by the movement of the driver 46 through movement of the gate 42 will assist in providing rigidity to the seal 10. When and if release of the seal 10 is desired, string 56 may be pulled uphole thereby drawing sleeve 44, driver 46 and telescopic member 36 uphole therewith. At the same time, since the seal 54 is contemporaneously withdrawn from the port 52, fluid within seal 10 may also escape and the seal 10 may then be brought back to pre-deployment condition.

Figure 4:
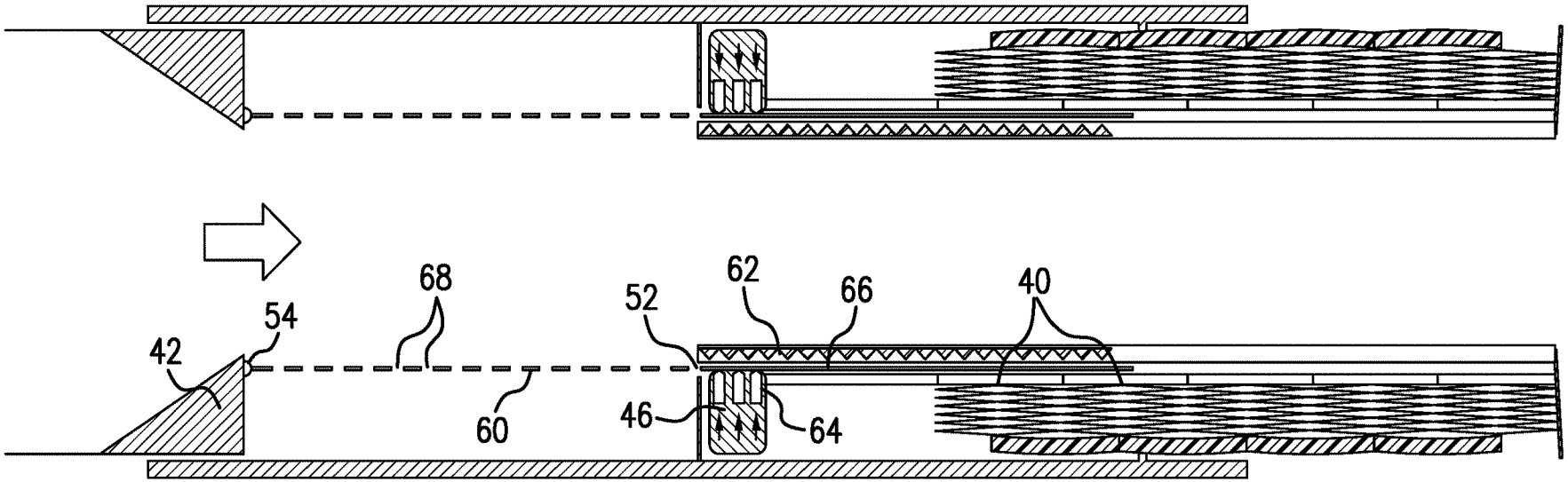
FIG. 4 is a schematic view of an alternate actuator arrangement for the seal as disclosed herein.

Referring to FIG. 4, only pressure is used to deploy the seal 10 and the structured elements 16. In this case, the fluid pressure entering through port 52 inflates the seal 10 and causes the structured elements to move along with the cover. The attachment points 40 are used oppositely to the way they were used in the embodiment of FIG. 3 in this case as they will pull the telescopic member 36 to a shorter condition based upon the fluid pressure filling the seal 10. The driver 46 then in this embodiment does not have the driving function but it does have a locking function to physically prevent collapse of the structured elements 16 until that action is commanded by an operator. This functionality is provided by a lock sleeve 60, a ratchet rack 62 and lock pins 64 working in concert. Specifically, as the driver 46 is drawn to the right in the figure with increasing radial dimension of the structured elements 16 due to fluid pressure against the seal 10, the lock pins 64 will slide along smooth section 66 of the lock sleeve 60. Then when whatever pressure threshold is achieved, weight is set down on the gate 42, driving lock sleeve 60 to the right in the figure. It will be noted that lock sleeve 60 has holes 68 therein. The holes 68 are alignable with the lock pins 64 to allow the lock pins 64 access to the ratchet rack 62. Once the gate 42 is compressed toward seal 10, the lock pins 64 will engage the ratchet rack 62 and the seal 54 will seal the port 52. At this point the structure is quite stable. If at a later time, it is desired to undeploy the seal 10, the gate 42 may be pulled uphole drawing the sleeve 60 with it. This will unlock the lock pins 64 and open the seal 54 allowing fluid to escape port 52 (assuming of course the system pressure is lower, which should be the case if the discussed operation is desired). The seal and structured elements will accordingly collapse back to their undeployed position.

Figure 5:
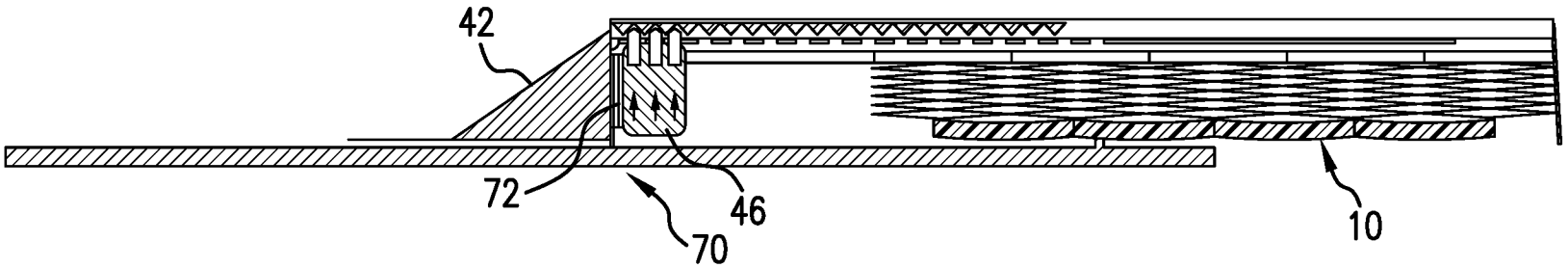
FIG. 5 is the arrangement of FIG. 4 with a retrieval configuration.
Figure 6:
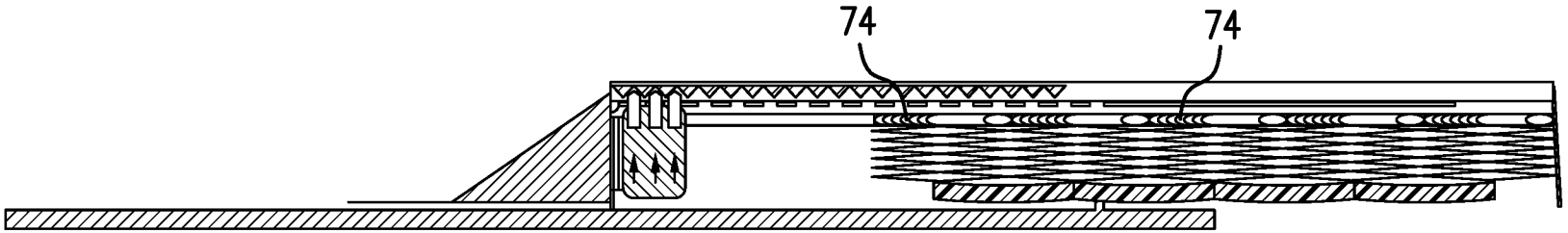
FIG. 6 is the arrangement of FIG. 4 with an alternate embodiment retrieval configuration.

FIGS. 5 and 6 both add a collapse functionality that assists in undeploying the seal 10. In each case, this is a biasing arrangement 70 that is forced to move against its natural inclination during deployment and will help to draw the structured elements 16 back to an undeployed position. The biasing arrangements are different from each other but could be employed together if desired. Referring to FIG. 5, the biasing arrangement 70 comprises a spring 72 disposed to act in tension on the driver 46. Therefore, during deployment, the spring is stretched out as the driver moves to the right of the figure. When pressure and locking features are released, the spring 72 draws the driver 46 back to the undeployed position and with it draws the telescopic member 36 to its extended position. Doing this will as the reader has already surmised from the above, cause the attachment points 40 to lengthen and the structured elements 16 to collapse.

Referring to FIG. 6, this same action is achieved using compression springs 74 inside of the telescopic member 36. When forces causing deployment of the seal 10 are released, the compressed springs 74 will urge the telescopic member 36 to extend thereby causing the structured elements 16 to collapse.

For each of the biasing arrangement embodiments, the springs may be of any practical type including metal, elastomeric, etc. and may be in the form of coil springs or other types of springs.

Set forth below are some embodiments of the foregoing disclosure:

Embodiment 1

A seal including a fluid resistive cover, a structured element disposed at an inside surface of the cover and drawable with the cover between a first position and a second position.

Embodiment 2

The seal as in any prior embodiment wherein the structure element includes portions that are rigid or semi rigid.

Embodiment 3

The seal as in any prior embodiment wherein the cover is fluid impermeable.

Embodiment 4

The seal as in any prior embodiment wherein the cover comprises aramid fiber reinforced material.

Embodiment 5

The seal as in any prior embodiment wherein the structured element second position exhibits portions of the structured element that are substantially aligned perimetrically of the seal to achieve an increased hoop strength of the structured element.

Embodiment 6

The seal as in any prior embodiment wherein the structured element includes portions that are sized such that when aligned, a perimetric measurement is substantially similar to a perimetric measurement of a tubular in which the seal is configured to be set.

Embodiment 7

The seal as in any prior embodiment wherein the structured element includes repeating geometric shapes.

Embodiment 8

The seal as in any prior embodiment wherein the structured element includes diamond shapes.

Embodiment 9

The seal as in any prior embodiment wherein the structured element is bonded to the cover.

Embodiment 10

The seal as in any prior embodiment wherein the cover is overmolded on the structured element.

Embodiment 11

The seal as in any prior embodiment wherein the structured element is additively manufactured on the cover.

Embodiment 12

The seal as in any prior embodiment wherein the cover is additively manufactured.

Embodiment 13

The seal as in any prior embodiment wherein the structured element at least in part comprises a controlled dissolvable or degradable material.

Embodiment 14

The seal as in any prior embodiment further comprising an actuation arrangement.

Embodiment 15

The seal as in any prior embodiment wherein the actuation arrangement includes a telescopic member attached to the structured elements at attachment points.

Embodiment 16

The seal as in any prior embodiment wherein the actuation arrangement includes a driver lockable against unintended movement and attached to the telescopic member.

Embodiment 17

The seal as in any prior embodiment wherein the actuation arrangement includes a biasing arrangement.

Embodiment 18

The seal as in any prior embodiment wherein the biasing arrangement includes a spring attached to a driver.

Embodiment 19

The seal as in any prior embodiment wherein the biasing arrangement includes a spring disposed within a telescopic member.

Embodiment 20

The seal as in any prior embodiment wherein the actuation arrangement includes a lock sleeve shiftable between positions allowing driver movement and positions preventing driver movement.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A seal comprising: a fluid resistive cover; a structured element disposed at an inside surface of the cover and drawable with the cover such that the structured element follows the cover between a first position and a second position.

2. The seal as claimed in claim 1 wherein the structure element includes portions that are rigid or semi rigid.

3. The seal as claimed in claim 1 wherein the cover is fluid impermeable.

4. The seal as claimed in claim 1 wherein the cover comprises aramid fiber reinforced material.

5. The seal as claimed in claim 1 wherein the structured element second position exhibits portions of the structured element that are substantially aligned perimetrically of the seal to achieve an increased hoop strength of the structured element.

6. The seal as claimed in claim 1 wherein the structured element includes portions that are sized such that when aligned, a perimetric measurement is substantially similar to a perimetric measurement of a tubular in which the seal is configured to be set.

7. The seal as claimed in claim 1 wherein the structured element includes repeating geometric shapes.

8. The seal as claimed in claim 1 wherein the structured element includes diamond shapes.

9. The seal as claimed in claim 1 wherein the structured element is bonded to the cover.

10. The seal as claimed in claim 1 wherein the cover is overmolded on the structured element.

11. The seal as claimed in claim 1 wherein the structured element is additively manufactured on the cover.

12. The seal as claimed in claim 11 wherein the cover is additively manufactured.

13. The seal as claimed in claim 1 wherein the structured element at least in part comprises a controlled dissolvable or degradable material.

14. The seal as claimed in claim 1 further comprising an actuation arrangement.

15. The seal as claimed in claim 14 wherein the actuation arrangement includes a telescopic member attached to the structured elements at attachment points.

16. The seal as claimed in claim 15 wherein the actuation arrangement includes a driver lockable against unintended movement and attached to the telescopic member.

17. The seal as claimed in claim 14 wherein the actuation arrangement includes a biasing arrangement.

18. The seal as claimed in claim 17 wherein the biasing arrangement includes a spring attached to a driver.

19. The seal as claimed in claim 17 wherein the biasing arrangement includes a spring disposed within a telescopic member.

20. The seal as claimed in claim 14 wherein the actuation arrangement includes a lock sleeve shiftable between positions allowing driver movement and positions preventing driver movement.

* * * * *